US005775969A

United States Patent [19]

Pedersen

[11] Patent Number: 5,775,969

[45] Date of Patent: Jul. 7, 1998

[54] TOY ELEMENT COMPRISING A HOLDER AND A THIN FLEXIBLE MATERIAL

[75] Inventor: Lars Pedersen, Billund, Denmark

[73] Assignee: INTERLEGO AG, Baar, Switzerland

[21] Appl. No.: 617,767

[22] PCT Filed: Sep. 21, 1994

[86] PCT No.: PCT/DK94/00356

§ 371 Date: Mar. 19, 1996

§ 102(e) Date: Mar. 19, 1996

[87] PCT Pub. No.: WO95/08380

PCT Pub. Date: Mar. 30, 1995

[30] Foreign Application Priority Data

Sep. 22, 1993 [DK] Denmark ..... 1067/93

[51] Int. Cl.[6] ..... A63H 33/08; A63H 19/00; A63H 33/00

[52] U.S. Cl. ..... 446/110; 446/82; 446/128; 446/486

[58] Field of Search ..... 446/82, 85, 107, 446/108, 109, 110, 119, 128, 479, 482, 486, 490; 40/515

[56] References Cited

U.S. PATENT DOCUMENTS

| | | | |
|---|---|---|---|
| 798,873 | 9/1905 | Case | 40/515 |
| 1,766,896 | 6/1930 | Goyke et al. | 40/515 |
| 2,834,150 | 5/1958 | White | 446/82 X |
| 3,640,017 | 2/1972 | Christiansen | 446/128 X |
| 3,839,816 | 10/1974 | Fischereder | 446/82 |
| 4,731,042 | 3/1988 | McKay et al. | 446/486 X |
| 5,352,149 | 10/1994 | Melashenko et al. | 446/490 X |

FOREIGN PATENT DOCUMENTS

| | | | |
|---|---|---|---|
| 1406787 | 6/1965 | France | 446/479 |
| 381097 | 9/1923 | Germany | 446/110 |
| 2335487 | 2/1975 | Germany . | |

OTHER PUBLICATIONS

PCT International Application No. WO 93/04622—Filed Aug. 28, 1992.

*Primary Examiner*—D. Neal Muir
*Attorney, Agent, or Firm*—Kane,Dalsimer,Sullivan, Kurucz, Levy, Eisele and Richard, LLP

[57] ABSTRACT

A toy element having a thin, flexible material as well as a holder for it is provided. The toy element may be used in the construction of a doll house for which it constitutes a curtain and the suspension, in the form of a rod, for the curtain. An elongated cavity having a longitudinal slot through which the flexible material extends is provided in the holder. A locking part couples to the holder and secures the rod holding the curtain in position.

10 Claims, 3 Drawing Sheets

TOY ELEMENT COMPRISING A HOLDER AND A THIN FLEXIBLE MATERIAL

BACKGROUND OF THE INVENTION

The present invention concerns a toy element comprising a thin, flexible material and means for suspending it.

In connection with e.g. doll's houses it is known to use such devices which, in this connection, can form window curtains or shower curtains, with associated suspension. These known devices may be formed by a traditionally suspended curtain rod, i.e. a rod suspended by e.g. a suspension fitting at each of its ends, with the associated curtain hung up on the curtain rod. An alternative solution is e.g. to secure the curtain fabric directly to the wall of the doll's house by glueing or other known methods.

Since, as it well-known, toys are frequently subjected to rather rough handling during play, these known devices frequently involve the problem either that the thin, flexible material, which forms e.g. a curtain, can easily be torn because of the manner in which it is secured to the toy, e.g. by glueing, stitching, etc. or that the suspension device, e.g. the above-mentioned curtain rod with traditional fittings, is made relatively fragile in order to have reasonably natural dimensions and can therefore easily break.

The above-mentioned-problem also arises in other toy connections where a thin, flexible material is to be suspended from or secured to a stationary element.

SUMMARY OF THE INVENTION

The object of the invention is therefore to provide a toy element comprising a thin, flexible material, such as a plastics sheet and woven textiles, as well as means for suspending it, so that tearing of the thin, flexible material as well as its suspension means is made difficult, while making the toy element suitable to create the illusion of e.g. window curtains or shower curtains and the like, which means i.a. that it must be possible to adapt the toy element in such a manner that the thin, flexible material can be moved on its suspension so as to have a reasonable function e.g. as a curtain.

This object is achieved with a toy element in accordance with the present invention, since, when it is attempted to pull the thin, flexible material out of the longitudinal slot, said material acts on the holding means enclosed in the longitudinal cavity so as to provide a clamping effect between the said holding means and the elongate cavity on both sides of the holding means, said thin, flexible material, which encloses the holding means, being retained by clamping action on both sides of the holding means. Since this clamping action is provided solely by a pull in the thin, flexible material, there will be no permanent clamping effect that may be destructive for the thin, flexible material, and the thin, flexible material does not drop down when the clamping action ceases. In addition, it is possible to avoid discrete fittings which are used e.g. in connection with suspension of curtain rods at its ends, since the suspension member may be constructed such that it can be secured to an underlying structure along its entire length, without this reducing the possibility of moving the thin, flexible material on the suspension.

The invention additionally improves the protection against tearing of the thin, flexible material, since, when engaging the inner side of the cavity, the rod member locks the thin, flexible material in a continuous engagement with the inner side of the cavity.

The invention defines an expedient embodiment providing a special structure which is easy to mount and easy to manufacture, since the cavity and the longitudinal slots are not established until the main element and the locking parts are assembled, thereby making it simple to position the thin, flexible material as well as the holding means prior to the assembling process.

The invention provides a considerably reduced friction between the thin, flexible material and the associated holder when the thin material is moved in the holder.

Depending upon the use of the thin, flexible material, e.g. a window curtain, a shower curtain, the shape of the cavity and the slots may be adapted to the use, e.g. be rectilinear or curve-shaped.

Embodiments of the invention are also defined which make the invention suitable in connection with toy building sets.

BRIEF DESCRIPTION OF THE DRAWINGS

Embodiments of the invention are described more fully below with reference to the drawing, in which.

DETAILED DESCRIPTION OF THE PREFERRED EMBODIMENT

Figure 1:
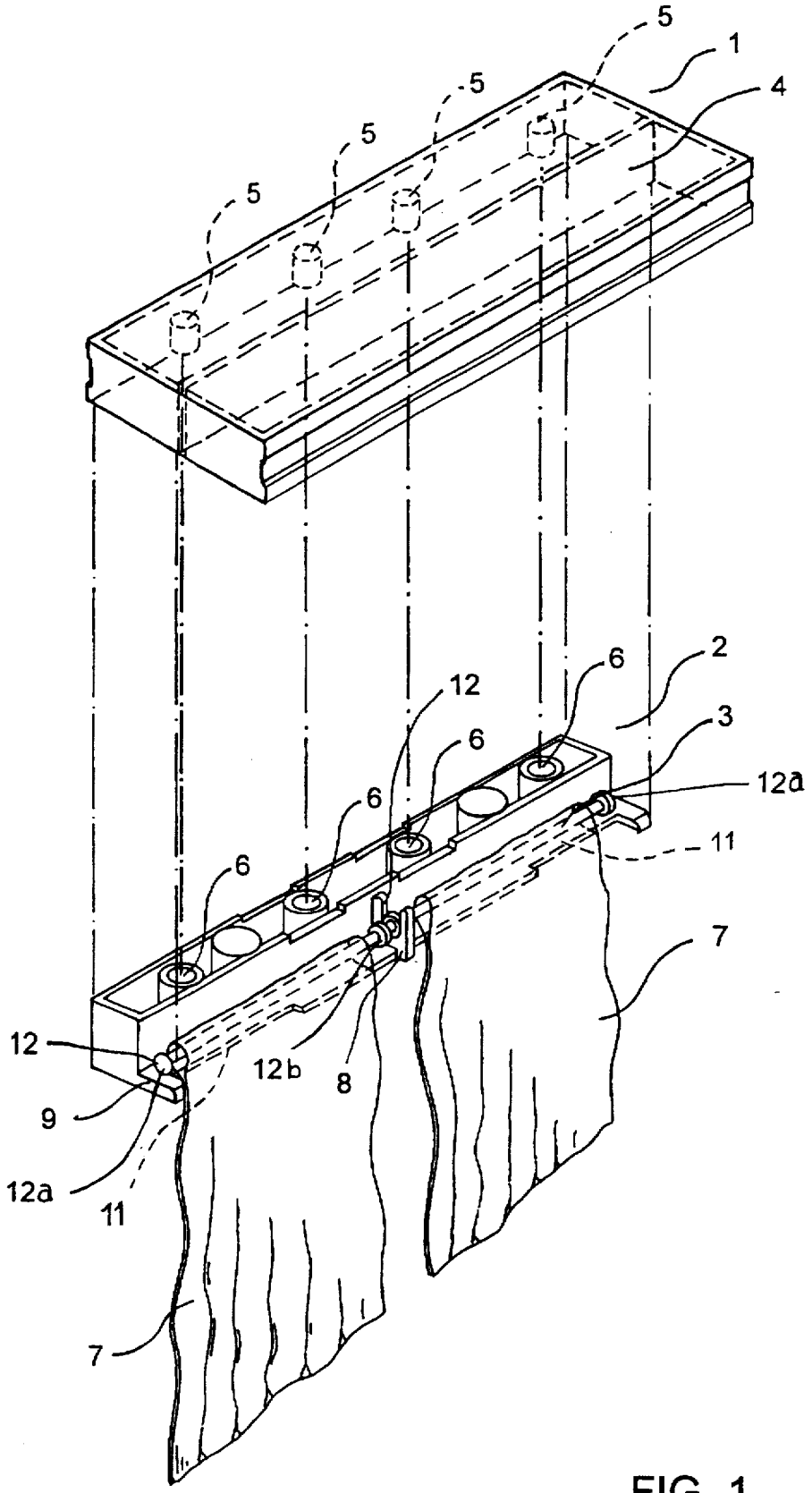
FIG. 1 shows a perspective view of a toy element according to the invention prior to assembly.

FIG. 1 thus shows a toy element according to the invention before the element is finished. Most of the non-visible contours are shown in dotted line. The element is formed by a main element 1, a locking part 2 and a rod 3, on which two pieces of fabric, sheet or the like 7 are mounted. Such an element may e.g. be used as a curtain in a doll's house.

The main element 1 is open downwardly and is divided longitudinally by the central wall 4 so as to form two downwardly open cavities. One of these cavities accommodates downwardly extending guide studs 5.

The locking part 2 is adapted to be positioned in the studded cavity of the main element, i.e. by sliding the locking part 2 into the main element 1 along the shown dash-and-dot lines. For this purpose the locking part is provided with guide tubes 6 which are adapted to receive the guide studs 5 in the main element 1 so that the main element 1 and the locking part 2 are positioned with respect to each other. Various assembling principles may be used depending upon whether it is desired that the element must be capable of being disassembled following assembly; thus, the guide studs 5 and the guide tubes 6 may glued together or be assembled in a simple frictional connection. In addition, the guide studs 5 and the guide tubes 6 may comprise snap-locking parts which can engage each other, either reversibly or irreversibly.

Further, the locking part 2 is provided with a hook 8 to retain the curtain rod 3 with respect to the locking element 2, said hook 8 facilitating the mounting during the assembling process. Below the curtain rod 3, the locking element 2 is provided with a wall 9 designed such that the wall 9, in combination with the central wall 4 in the main element defines a cavity following assembling of the element, in which the curtain rod 3 is positioned, as well as a slot 10, so that the curtain extends from the cavity through the slot 10 and out of the element. The slot 10 has a width which is smaller than the profile of the curtain rod 3, thereby ensuring that the curtain rod 3 cannot be pulled out of the element after this has been assembled.

In the embodiment shown in FIG. 1 the curtains 7 can be moved on the curtain rod 3, which improves the play value of the element of course. To accommodate the curtains 7 when these are drawn aside, the width of the slot 10 is increased at its ends by the stepped formations 11.

At its ends and in the center, the curtain rod 3 is provided with thickenings 12*a*, 12*b* which, in addition to serving to fix the curtain fabric 7, also ensure that the curtain rod 3 is lifted away from the slot, thereby providing low friction when the curtains 7 are moved on the curtain rod 3. The latter effect might also be obtained by providing the wall 9 with supports. The central thickenings 12*b*, in combination with the hook 8, moreover serve to fix the curtain rod 3 in the locking part 2, which additionally facilitates the assembling process..

Figure 2:
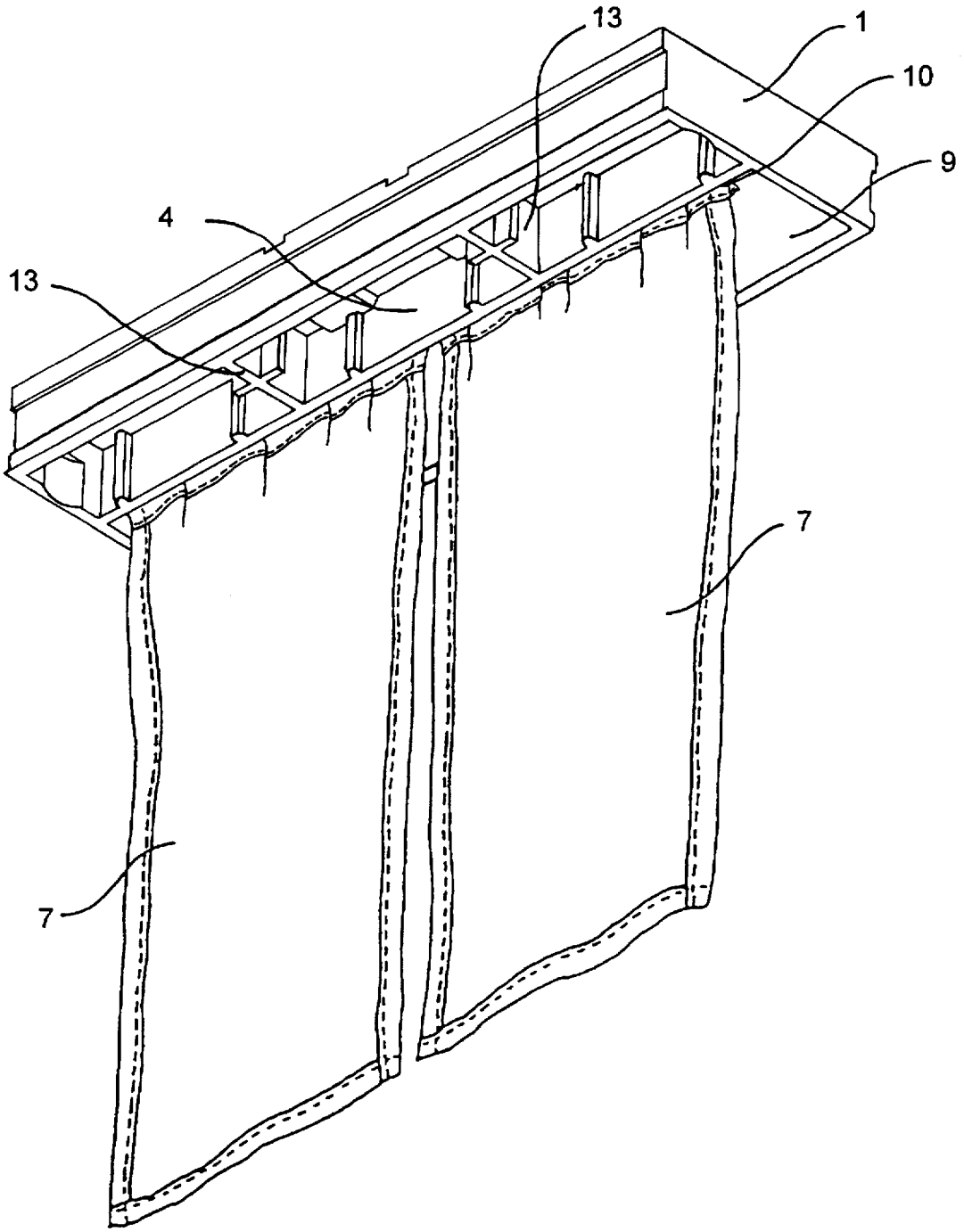
FIG. 2 shows the toy element of FIG. 1 in the assembled state, seen obliquely from below.

FIG. 2 is a bottom view of the element after the assembling process. The curtains 7 hang out through the slot 10, which is defined by the main element 1 and its central wall 4 as well as the lower wall 9 of the locking part 2. At the opposite side of the central wall 4, the main element 1 is open downwardly and provided with ribs 13 which serve to stiffen the central wall 4. Further, the central wall 4 and the ribs 13 are adapted so as to frictionally engage protruding stud parts on another element (not shown), so that the element may be incorporated in a toy building set, e.g. by mounting on a supporting structure.

Figure 3:
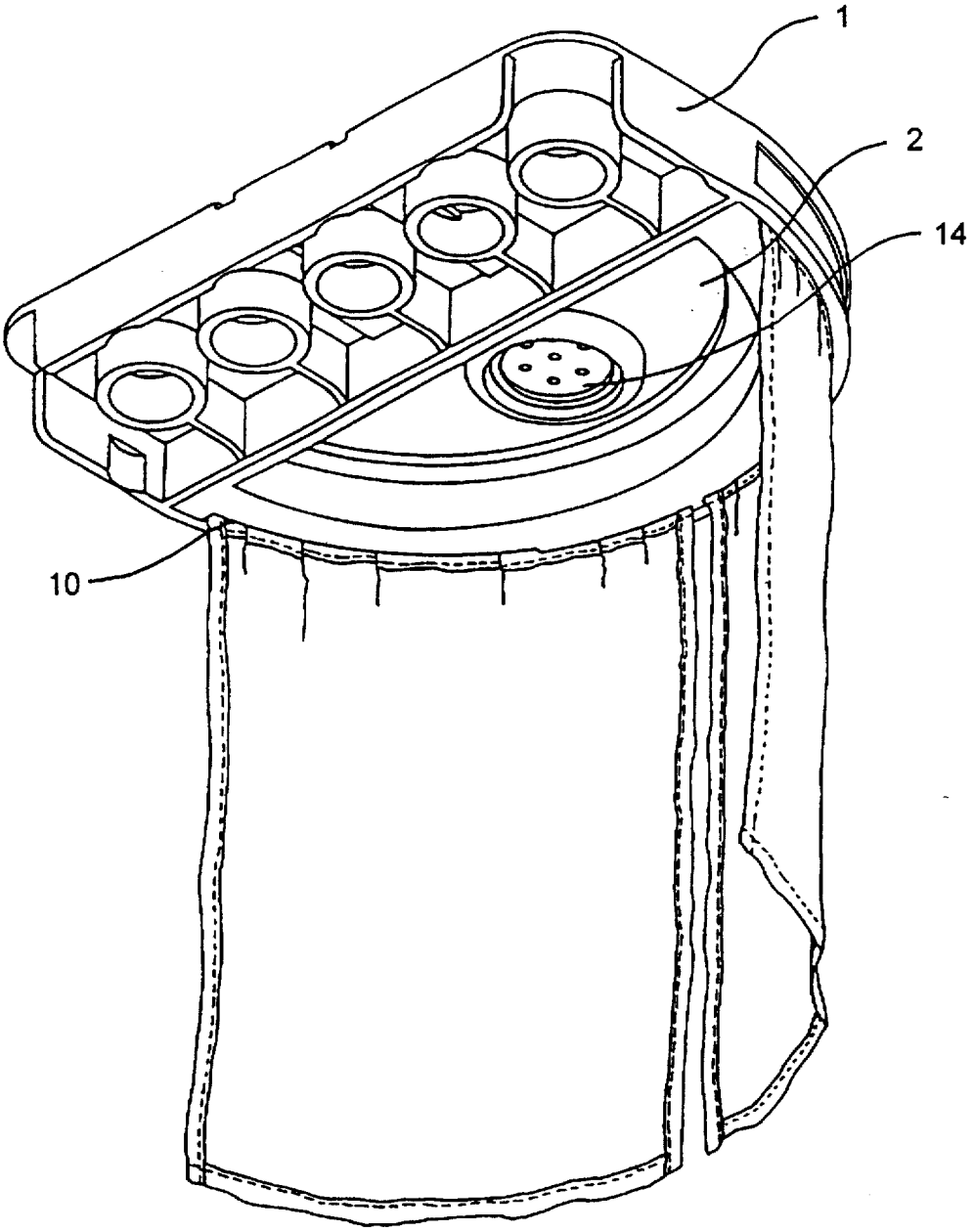
FIG. 3 shows a second embodiment of the invention in the assembled state, seen from below.

FIG. 3 shows an alternative embodiment of the invention, in which the main element together with a locking part 2 defines a slot 10 shaped as a circular arc. This element may conceivably be used as a shower curtain in a doll's house, and the locking element is therefore provided with a dummy 14 which simulates a shower head. The element is shown as an alternative embodiment of the basic principle of the invention, and it is evident that this principle may be varied in a very large number of different embodiments, depending upon the use.

I claim:

1. An element to be used as a toy, e.g. for dollhouses, comprising a holder (1, 2) and a thin, flexible material (7) as well as coupling means for mounting the flexible material (7) in the holder (1, 2), characterized in that the coupling means comprise an elongate cavity in the holder with a longitudinal slot (10), said cavity encasing flexible holding means (3) and that the flexible material (7) extends through the slot (10) and includes portions disposed about the holding means (3) in such a manner that the thin, flexible material can be slidably moved on the holding means, and wherein the width of the slot is less than the holding means cross-sectional dimension so that upon attempt to pull the thin, flexible material (7) out of the longitudinal slot, said material (7) acts on the holding means (3) to provide a clamping effect between the holding means (3) and the surfaces of said elongate cavity adjacent said slot on both sides of the holding means (3).

2. An element according to claim 1, characterized in that the holding means (3) are formed by a rod member, and that a casing is formed in the flexible material (7) to enclose the rod member (3).

3. An element according to claim 1, characterized in that the holder is formed by a main element (1) and a locking part (2) for coupling to the main element (1) to define the cavity and the longitudinal slot (10).

4. An element according to claim 2 characterized in that the rod member has two ends and in that supporting means (12*a*, 12*b*) are provided at least at the two ends of the rod member (3), and that the supporting means (12*a*, 12*b*) are adapted to hold the rest of the rod member (3) without the rod member making contact with the walls of the cavity.

5. An element according to claims 1, 2, 3 or 4 characterized in that the slot (10) and the cavity are rectilinear.

6. An element according to claims 1, 2, 3 or 4 characterized in that the slot (10) and the cavity are curve-shaped.

7. An element according to claims 1, 2, 3 or 4 characterized in that the holder is a separate element provided with coupling means for coupling to complementary coupling means on a supporting structure.

8. An element according to claim 7, characterized in that the coupling means comprise coupling parts which are adapted to receive coupling studs on the carrying structure.

9. An element according to claim 7, characterized in that the coupling means are adapted to be inserted into complementary guide parts on the carrying structure.

10. An element according to claim 9, characterized in that it comprises snap parts adapted to engage complementary snap parts in the carrying structure in the inserted position of the toy element.

* * * * *